United States Patent [19]

Wobig

[11] Patent Number: 4,912,953

[45] Date of Patent: Apr. 3, 1990

[54] RE-KEYABLE CYLINDER LOCK

[75] Inventor: Gerald C. Wobig, Sikeston, Mo.

[73] Assignee: National Lock Corporation, Sikeston, Mo.

[21] Appl. No.: 250,861

[22] Filed: Sep. 29, 1988

[51] Int. Cl.[4] ..... E05B 25/00

[52] U.S. Cl. ..... 70/383; 70/337; 70/385

[58] Field of Search ..... 70/337, 338, 340, 382–385

[56] References Cited

U.S. PATENT DOCUMENTS 2,113,007 4/1938 Swanson ..... 70/385
2,326,358 8/1943 Hull ..... 70/385
2,427,837 9/1947 Connell ..... 70/383
4,185,480 1/1980 Pechner ..... 70/383 X

*Primary Examiner*—Gary L. Smith
*Assistant Examiner*—Suzanne L. Dino
*Attorney, Agent, or Firm*—Lackenbach Siegel Marzullo & Aronson

[57] ABSTRACT

A cylinder lock is adapted to be re-keyed by a change key which, as an incident to turning a plug in a cylinder, shifts a shuttle transversely of the cylinder. The shuttle carries three sets of drive and master pins which may be selectively brought into active position relative to the plug by shifting the shuttle transversely.

9 Claims, 5 Drawing Sheets

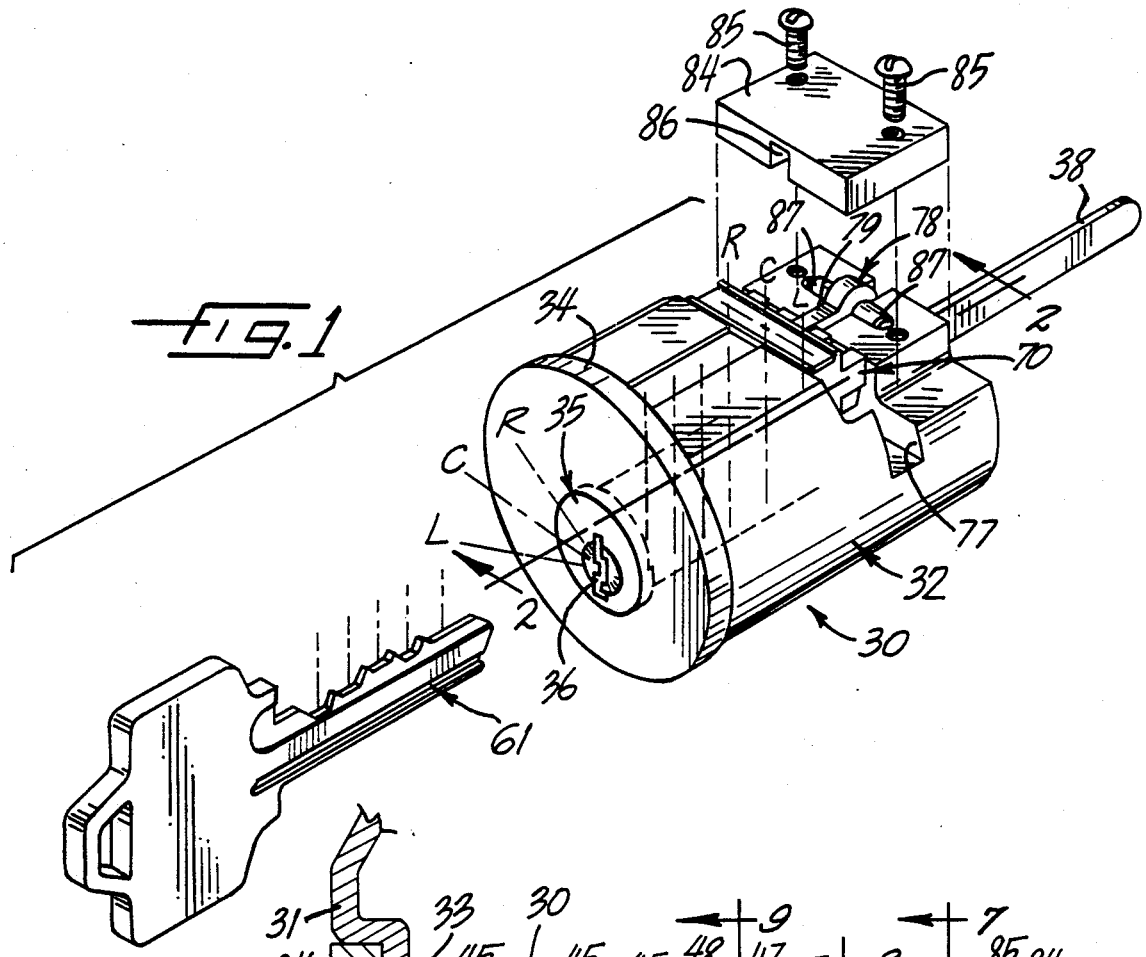
FIG. 1
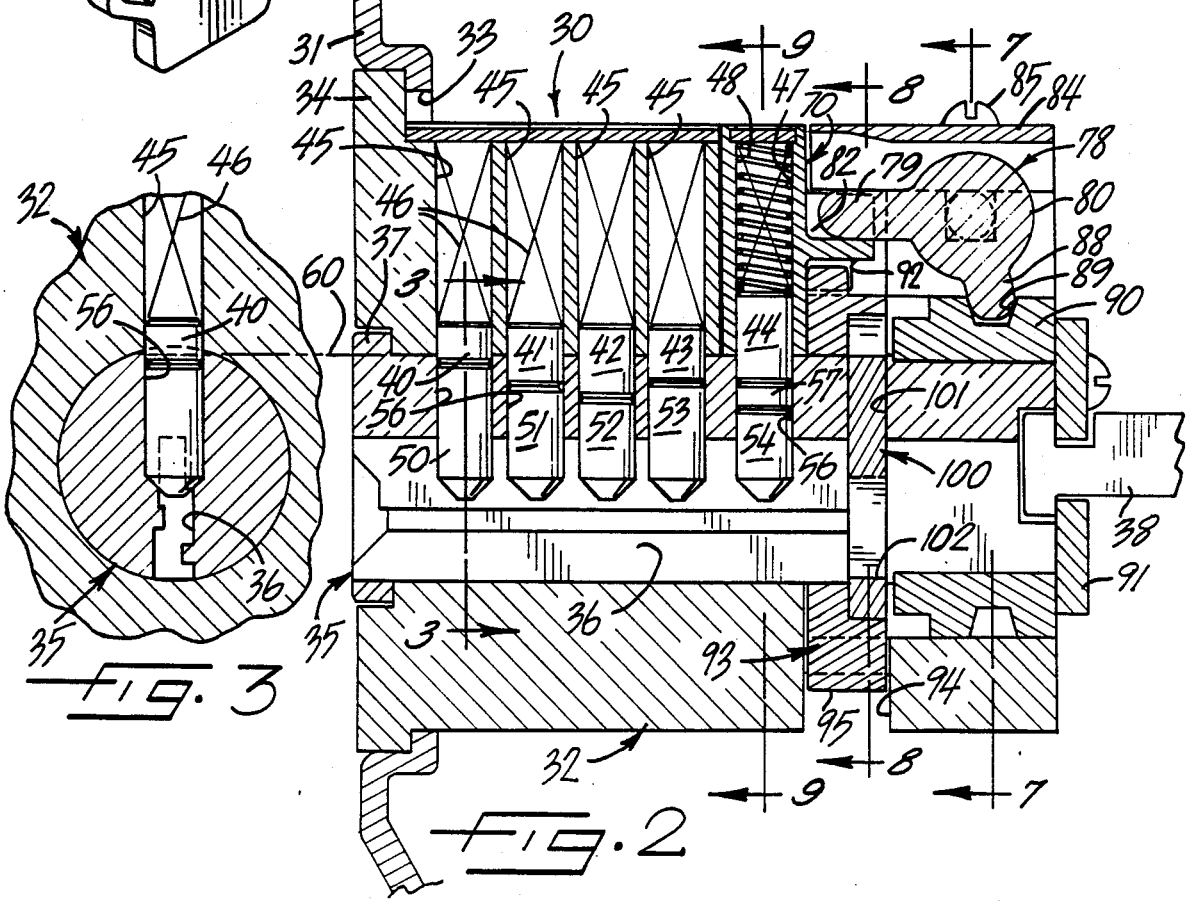
FIG. 3
FIG. 2

CENTER KEY

MASTER KEY

CHANGE KEY

LEFT KEY

RIGHT KEY

RE-KEYABLE CYLINDER LOCK

BACKGROUND OF THE INVENTION

This invention relates to a cylinder lock of the type in which an elongated plug is rotatably supported in a cylinder. Axially spaced and radially movable driver pins are slidably supported in holes in the cylinder while axially spaced and radially movable tumbler pins are slidably supported in holes in the plug. The tumbler pins in the plug are alined axially with the driver pins in the cylinder and normally are alined angularly with the driver pins. The interface between each tumbler pin and each alined pin in the cylinder normally is spaced radially from a shear line located between the plug and the cylinder. As a result, the pins prevent the plug from being turned in the cylinder and thereby prevent the lock from being operated.

When a proper key is inserted into a keyway in the plug, the pins are shifted radially to cause the interfaces between the tumbler pins and the alined pins in the cylinder to lie precisely on the shear line. The plug then may be turned by the key to effect operation of the lock.

In certain locks, and particularly in door locks for apartments, it is desirable to be able to re-key the lock, that is to say, to change the lock over so that it no longer can be operated by the original user key and can only be operated by another user key with different bitting. When an apartment door lock is rekeyed, a former tenant who has retained a key is prevented from using the key to unlock the door of the new tenant.

A locksmith may re-key a lock by disassembling the lock and replacing one or more of the pins with a pin or pins of different length. In some locks, re-keying may be effected by the building owner or superintendent by inserting a special change key into the plug in order to change the effective length of one or more pins. Examples of such locks are disclosed in U.S. Pat. Nos. 3,078,705; 4,412,437 and 4,440,009. These locks require the use of special spacers which must be removed from the lock to change the effective length of the pins.

SUMMARY OF THE INVENTION

The general aim of the present invention is to provide a new and improved lock which may be re-keyed with a change key in a relatively simple manner and without need of removing any parts from the lock or installing any new parts in the lock.

A more detailed object of the invention is to achieve the foregoing by providing a lock having a shuttle which carries multiple driver pins for use in the cylinder. By shifting the shuttle with a change key, a driver pin may be moved from an active position in the cylinder and replaced in the active position by a pin of different length so as to prevent operation of the lock by a first user key and to permit operation of the lock by a second user key.

The invention also resides in the provision of unique means for shifting the shuttle in response to movement of the change key and in the provision of novel means for retaining the shuttle releasably in any position to which it is shifted.

These and other objects and advantages of the invention will become more apparent from the following detailed description when taken in conjunction with the accompanying drawings.

BRIEF DESCRIPTION OF THE DRAWINGS

FIG. 1 is an exploded perspective view of a new and improved lock incorporating the unique features of the present invention, one of the user keys also being shown.

FIG. 2 is an enlarged fragmentary cross-section taken substantially along the line 2—2 of FIG. 1.

FIG. 3 is a fragmentary cross-section taken substantially along the line 3—3 of FIG. 2.

FIG. 10 being similar to FIG. 8 but showing the lock with the change key inserted into plug.

DETAILED DESCRIPTION OF THE PREFERRED EMBODIMENT

Figure 4:
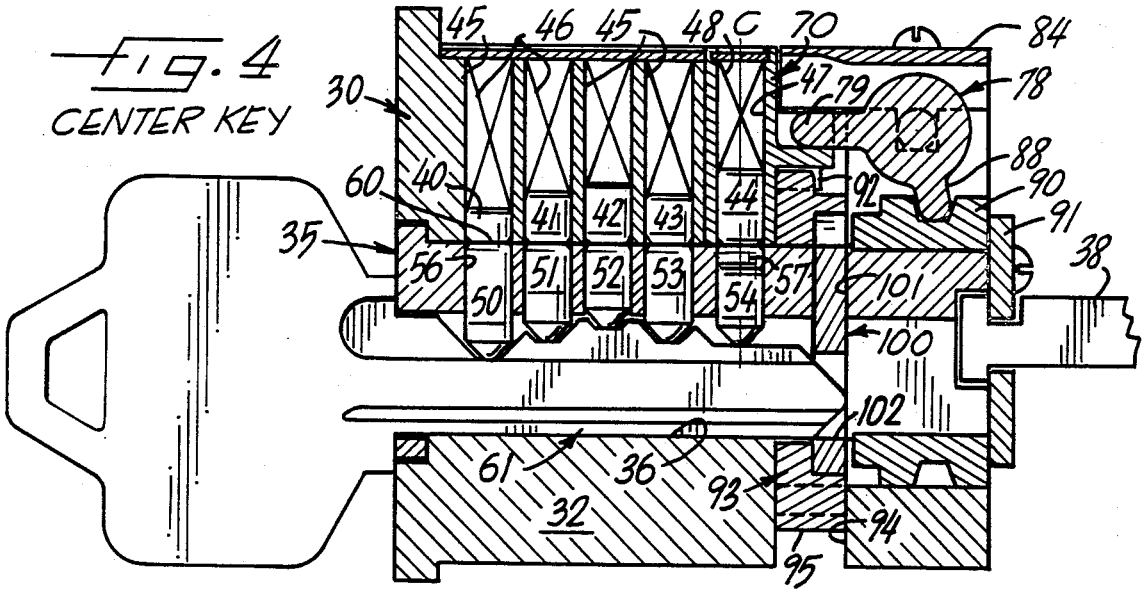
FIGS. 4, 5 and 6 are views similar to FIG. 2 but show the lock in connection with a user key, a master key and a change key, respectively.

For purposes of illustration, the invention has been shown in the drawings as embodied in a cylinder lock 30 of the type which may be used with a locking mechanism such as a deadbolt (not shown) in order to securely lock a door (not shown). The lock includes a body 31 (FIG. 2) and includes a cylinder 32 adapted to be received in a hole 33 in the body. The cylinder is formed with a radially extending flange 34 which lies against the front side of the lock body.

Telescoped rotatably into the cylinder 32 is an elongated plug 35 which is formed with a longitudinally extending keyway 36 (FIG. 2) for receiving a key. A radially extending flange 37 (FIG. 2) on the front end of the plug lies against the front end of the cylinder 32. Connected to the rear end of the plug is an elongated spindle 38 which also is connected in a conventional manner to the operating mechanism of the deadbolt. Rotation of the plug and the spindle in one direction effects locking of the deadbolt while rotation in the opposite direction effects unlocking of the deadbolt. The plug normally is positioned with the keyway 36 extending vertically as shown in FIG. 1.

Normally, the plug 35 is held against rotation in the cylinder 32. For this purpose, driver pins 40 to 44 (FIG. 2) in the cylinder coact with tumbler pins 50 to 54 in the plug to prevent rotation of the plug unless a proper key is inserted into the keyway 36 of the plug. Herein, the four forwardmost driver pins 40 to 43 are supported for radial sliding in four angularly alined and axially spaced chambers or bores 45 formed in the cylinder 32. Coil springs 46 are located in the bores 45 and engage the ends of the pins 40 to 43 so as to urge the pins radially inwardly toward the plug 35. The rear driver pin 44 is supported for radial sliding in a rearmost hole or chamber 47 which will be described in more detail subsequently. The pin 44 is urged inwardly by a coil spring 48.

The five tumbler pins 50 to 54 are identical to one another except for length and are supported for radial sliding in five axially spaced and angularly alined chambers or bores 56 formed in the plug 35. The inner ends of the tumbler pins 50 to 54 normally extend into the keyway 36 and normally bottom against shoulders on the sides of the keyway so as to limit radially inward movement of the tumbler pins (see FIG. 3).

Interposed between the driver pin 44 and the alined tumbler pin 54 is a master pin 57. In a manner which will be described subsequently, the tumbler pin 54 enables the lock 30 and a series of like locks with master pins of different lengths to be operated by a single master key.

Normally, the interfaces between the inner ends of the driver pins 40 to 43 and the outer ends of the alined tumbler pins 50 to 53 are spaced radially inwardly from a shear line 60 defined between the cylinder 32 and the plug 35 (see FIG. 2). Also, the interface between the inner end of the rear driver pin 44 and the outer end of the master pin 57 normally is spaced radially inwardly from the shear line. As a result, the pins 40 to 44 in the cylinder 32 normally project into the holes 56 in the plug 35 as shown in FIG. 2 so as to prevent turning of the plug in the cylinder and thereby prevent operation of the lock 30.

When a user key 61 (i.e., a pass key) is inserted into the keyway 36 as shown in FIG. 4, the various bits of the key engage the inner ends of the tumbler pins 50 to 54 and shift those pins radially outwardly to effect radial outward shifting of the driver pins 40 to 44 and the master pin 57. If the key 61 is in fact an authorized user key, the pins are shifted to a position such that the interfaces between the pins 40 to 43 and 50 to 53, respectively, and the interface between the driver pin 44 and the master pin 57 lie precisely at the shear line 60 (see FIG. 4). Accordingly, the key 61 may be rotated to turn the plug 35 in the cylinder 32 and effect operation of the lock 30.

Figure 5:
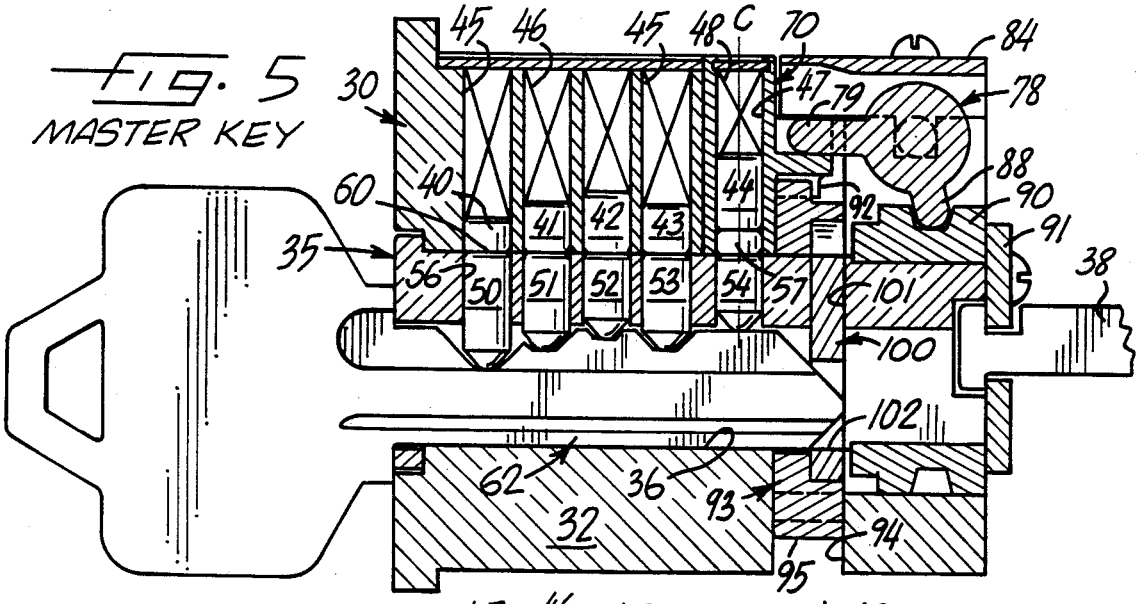

FIG. 5 shows the lock 30 in connection with a master key 62 which may be used to operate the lock 30 and a series of like locks. When the master key is inserted into the keyway 36, the pins 40 to 43 and 50 to 53 are shifted to the same position as before but the pins 44, 54 and 57 are shifted to a position in which the interface between the tumbler pin 54 and the master pin 57 is located on the shear line 60 (see FIG. 5). If a lock identical to the lock 30 is equipped with a master pin of a different length from the master pin 57, the former lock can be operated by the master key 62 but not by the user key 61.

In some instances, and particularly in apartments, it is desirable to be able to convert the lock 30 so as to prevent operation of the lock by one user key and to permit the lock to be operated by a different user key. When a lock is so converted, a new tenant is given reasonable assurance that a previous tenant will not be able to use a previously issued key to enter the apartment.

Figure 6:
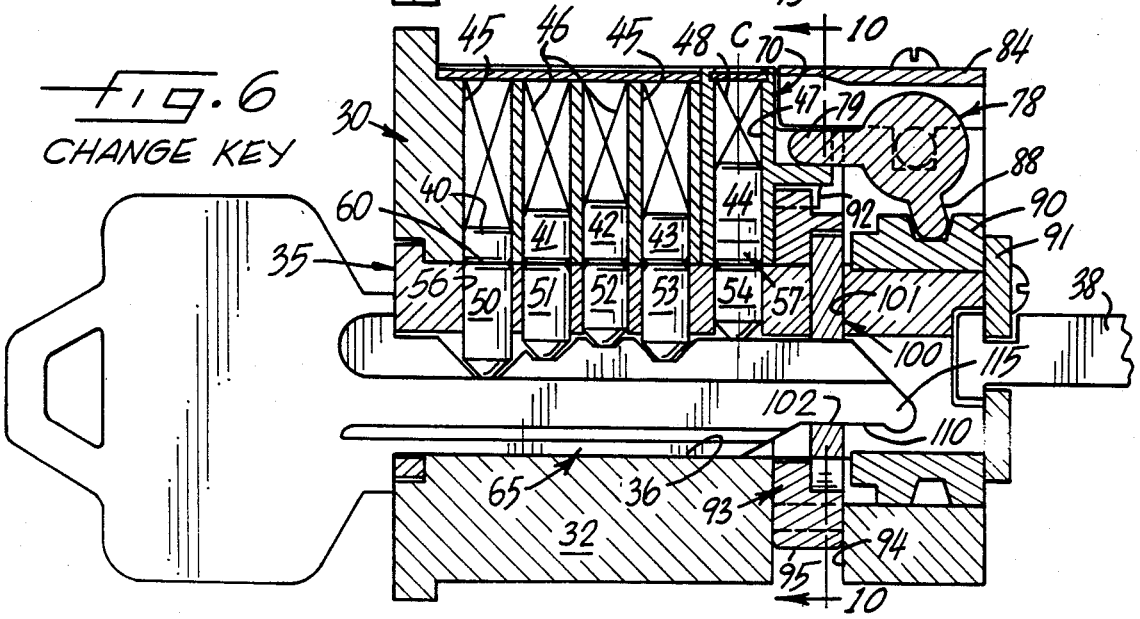
Figure 9:
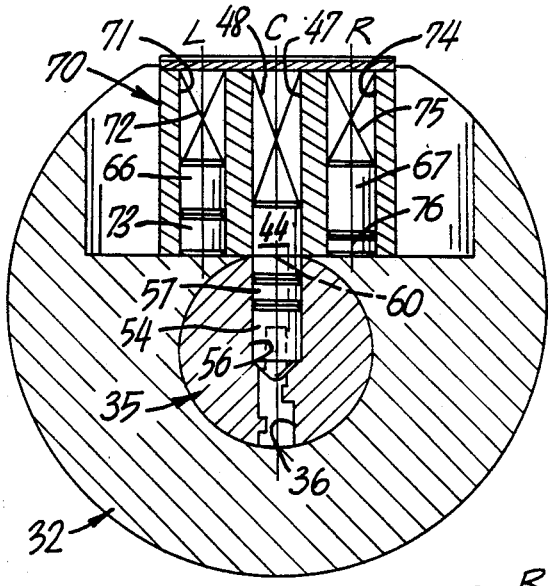
Figure 10:
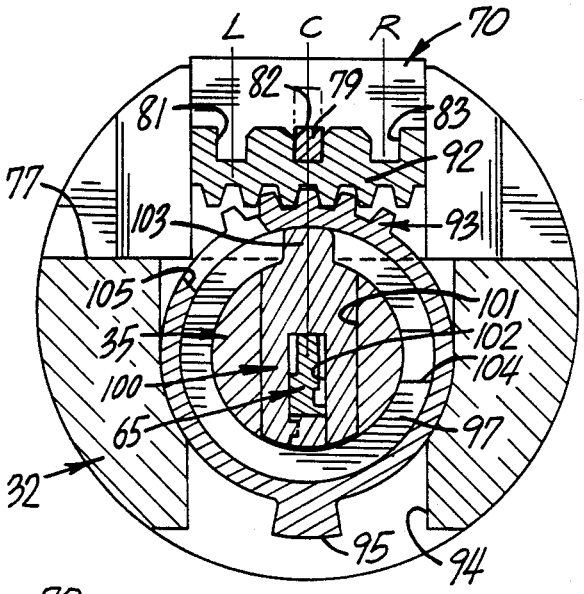
FIG. 10 is a cross-section taken substantially along the line 10—10 of FIG. 6.
Figure 25:
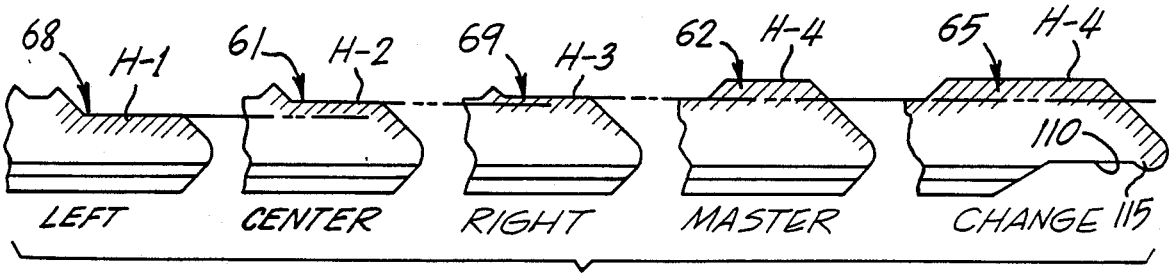
FIG. 25 is an elevational view showing the tip end portions of the three user keys, the master key and the change key.

In accordance with the present invention, the lock 30 is constructed in a unique manner such that a change key 65 (FIGS. 6 and 11) may be used to shuttle the rear drive pin-master pin set 44 and 57 out of an active position in the cylinder 32 and to bring either one of two additional drive pin-master pin sets 66, 73 or 67, 76 (FIG. 9) into the active position. The additional pin sets 66, 73 and 67, 76 differ from one another and from the pin set 44, 57 and, when in the active position, prevent the lock 30 from being operated by any user key other than user keys 68 and 69 (FIG. 25) which are specifically tailored to the pin sets 66, 73 and 67, 76 respectively. By virtue of the three pin sets which may be selectively shuttled into and out of the active position by the change key 65, the lock 30 may be changed over from operation by the user key 61 to operation by one of the user keys 68 or 69 and then subsequently may be changed over from operation by that user key to operation by one of the other user keys.

More specifically, the lock 30 includes a shuttle member 70 (FIGS. 8 to 11) formed with a radially elongated chamber which defines the chamber 47 for the driver pin 44, the spring 48 and the master pin 57. Formed in the shuttle member 70 and spaced transversely from one side of the chamber 47 is a second chamber 71 (FIG. 9) which houses the drive pin 66. The chamber 71 also houses a coil spring 72 which urges the drive pin 66 inwardly into engagement with a master pin 73 contained within the chamber 71 and having a length greater than that of the master pin 57.

A third chamber 74 (FIG. 9) is formed in the shuttle member 70 and is spaced transversely from the other side of the center chamber 47. The third chamber 74 houses the drive pin 67, a spring 75 and a master pin 76. The master pin 76 is shorter than either of the master pins 57 and 73.

For convenience, the vertical plane extending through the center chamber 47 in the shuttle 70 has been designated "C" in the drawings. The vertical plane extending through the left chamber 71 (as viewed from the rear of the lock 30) has been labeled "L" while the vertical plane extending through the right chamber 74 has been designated "R".

As shown most clearly in FIG. 1, the shuttle 70 is supported slidably within a transversely extending groove 77 formed in the upper rear portion of the cylinder 32. Normally, the shuttle is held releasably in one of three transverse positions in the groove. For this purpose, provision is made of a detent 78 (FIG. 2) having a forwardly projecting and generally horizontal finger 79 extending radially from a hub 80. The finger 79 is sized to enter any one of three transversely spaced and upwardly opening pockets 81, 82 and 83 (FIG. 11) formed in the rear side of the shuttle 70. When the finger is in a pocket, it prevents transverse shifting of the shuttle. The detent is covered by a cap 84 (FIG. 1) which is fastened to the cylinder 32 by screws 85, the cap being formed with a groove 86 for accommodating the finger 79.

Figure 7:
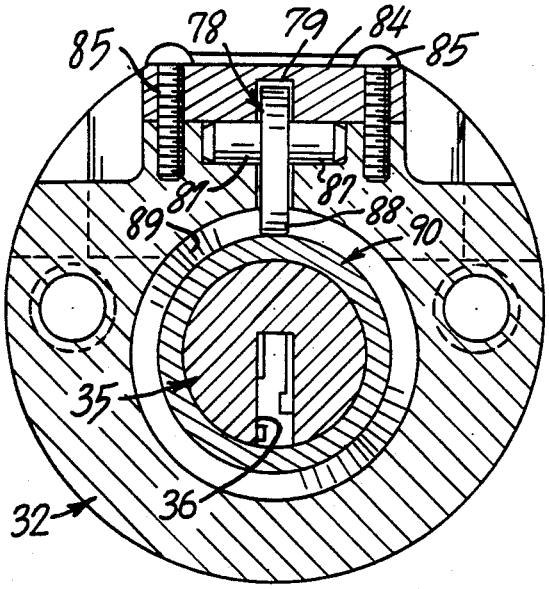
FIGS. 7, 8, and 9 are cross-sections taken substantially along the lines 7—7, 8—8 and 9—9, respectively, of FIG. 2.
Figure 8:
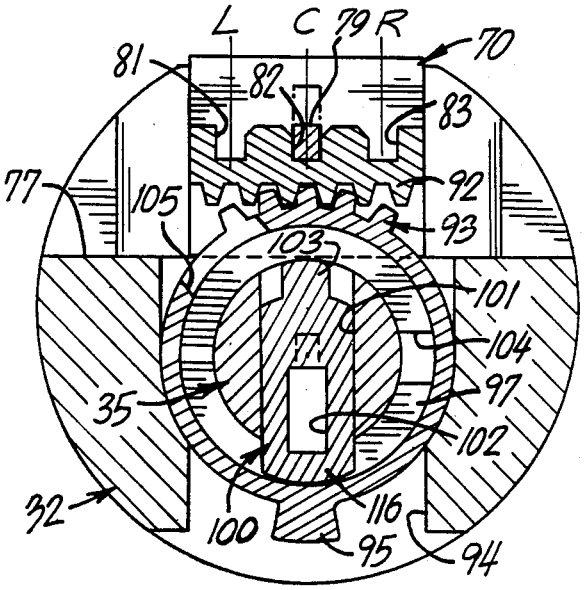

As shown in FIG. 7, the hub 80 of the detent 78 is formed with two transversely extending trunnions 87 which are received in upwardly opening grooves in the rear end portion of the cylinder 32. The detent 78 thus is supported to pivot about the axis of the trunnions 87. When the detent is pivoted clockwise (FIG.22), the finger 79 is lifted out of the pocket 81, 82 or 83 so as to free the shuttle 70 for transverse shifting. Pivoting of the detent is effected by means of a finger 88 (FIG. 2) projecting downwardly from the hub 80 of the detent and fitting within an annular groove 89 formed around a collar 90. The collar fits rigidly over the rear end portion of the plug 35 and is fixed axially thereon by a clamping plate 91.

Figure 22:
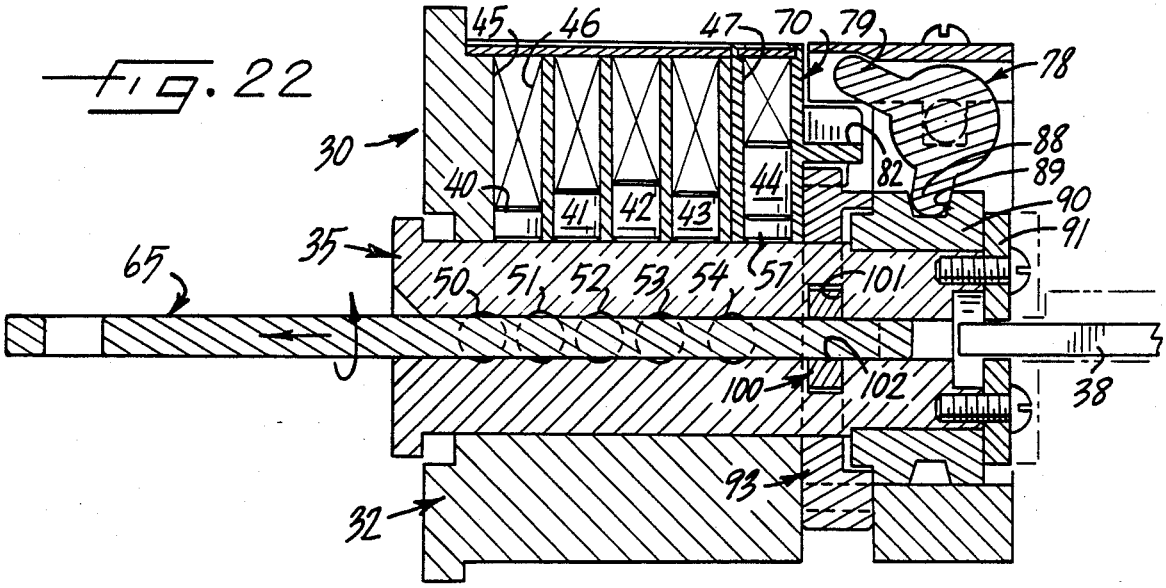
FIG. 22 is an enlarged fragmentary cross-section taken substantially along the line 22—22 of FIG. 14 and shows the lock in conjunction with the change key.
Figure 23:
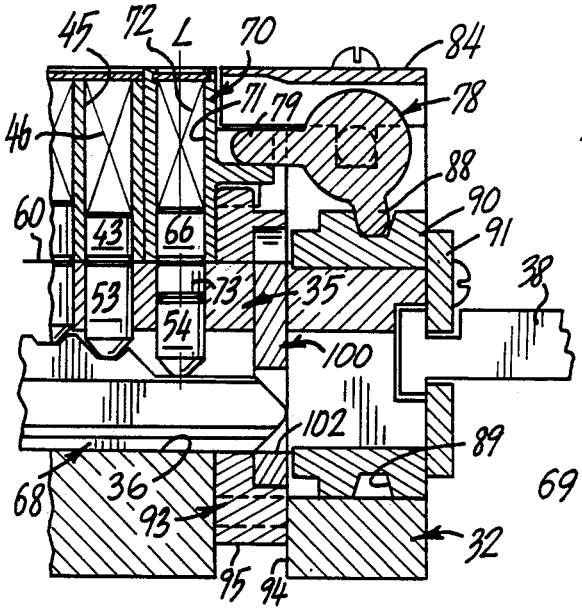
FIG. 23 is an enlarged fragmentary cross-section taken substantially along the line 23—23 of FIG. 18 and shows the lock in conjunction with the second user key.

If the plug 35 is pulled forwardly in the cylinder 32, the collar 90 moves forwardly with the plug and causes the groove 89 to act on the finger 88 to rock the detent 78 clockwise (FIG. 2). This swings the finger 79 upwardly out of the pocket 81, 82 or 83 as shown in FIG. 22 and frees the shuttle 70 for transverse sliding. When the plug 35 is returned rearwardly in the cylinder 32, the groove 89 in the collar 90 coacts with the finger 88 of the detent and rocks the detent counterclockwise to place the finger 79 in a pocket 81, 82 or 83.

Figure 11:
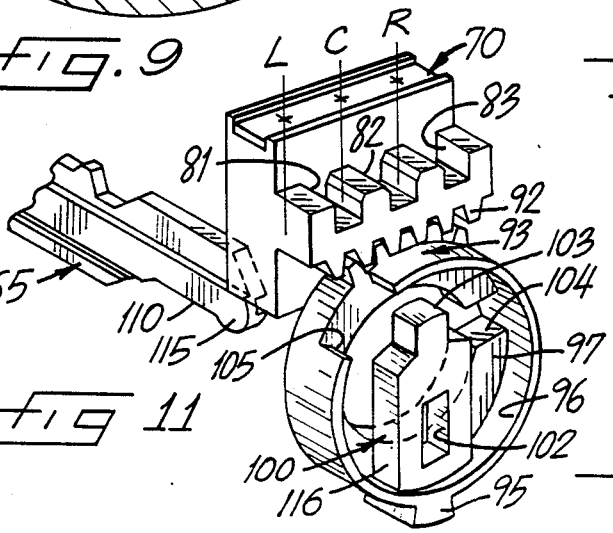
FIG. 11 is a perspective view of certain parts shown in FIG. 10.
Figure 12:
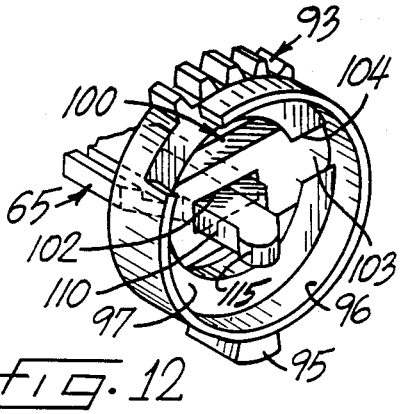
FIG. 12 is a perspective view generally similar to FIG. 11 but shows the change key rotated through ninety degrees.

The rear side of the shuttle 70 is formed with a transversely extending toothed rack 92 (FIGS. 8 and 11) located just below the pockets 81, 82 and 83. Transverse shifting of the shuttle is effected in response to rotation of an annular gear 93 which is coaxial with the plug 35 and which, under certain conditions, is rotated when the plug is turned in the cylinder 32. The gear is located in a slot 94 (FIG. 8) in the rear end portion of the cylinder and is formed with a radially outwardly projecting ear 95 which is adapted to engage opposite sides of the slot and limit total turning of the gear through an angle of about sixty degrees. As shown in FIGS. 11 and 12, the gear 93 is generally cup-shaped and is formed with an annular side wall 96 and a flat bottom wall 97.

The lock 30 is completed by a clutch element 100 (FIG. 8 and FIGS. 10 to 12) which normally permits the plug 35 to turn relative to the gear 93 but which, under certain circumstances, couples the gear to rotate in unison with the plug. In this instance, the clutch element 100 is in the form of a small rectangular bar which is received in a rectangular slot 101 (FIG. 8) formed in the rear end portion of the plug 35. A generally rectangular window 102 is formed through the central portion of the clutch bar 100 while a radially projecting lug 103 is formed on one end of the bar. Under certain circumstances, the lug is adapted to enter a notch 104 formed in the bottom wall 97 of the cup-shaped gear 93 and, when the lug is in the notch, the clutch bar 100 couples the gear 93 to rotate with the plug 35. During assembly of the lock 30, the clutch bar 100 may be inserted into the cup-shaped gear 93 by way of a slot 105 (FIG. 11) formed in the side wall 96 of the gear.

Now that all of the components of the lock 30 have been described, its operation will be explained. Preliminarily, reference is made to FIG. 25 which shows the tip portions of the keys 61, 62, 65, 68 and 69. As a matter of convenience to facilitate explanation of the operation of the lock, the user key 61 has been labeled as a "center" key; the user key 68 has been labeled as a "left" key; the user key 69 has been labeled as a "right" key; and the master and change keys 62 and 65 have been labeled as "master" and "change" keys, respectively. As is apparent from FIG. 25, the tip end bitting of the left user key 68 is at a height H-1; the tip end bitting of the center user key 61 is at a greater height H-2; the tip end bitting of the right user key 69 is at a still greater height H-3; and the tip end bittings of the master key 62 and the change key 65 are of greatest height H-4. Also, the tip end portions of the keys 61, 62, 68 and 69 are of the same length and have a conventional V-shape configuration. The tip end portion of the change key 65 has a greater length than the tip end portions of the other keys and, in addition, the lower edge of the tip end portion of the change key is relieved as indicated at 110 in FIG. 25.

Assume that the lock 30 is initially set up with the shuttle 70 positioned such that the center chamber 47 of the shuttle is alined with the rearmost chamber 56 of the plug 35. When the lock is in this condition, the parts are positioned in the manner shown in FIGS. 1 to 15 and FIG. 22. Now assume that the center user key 61 is inserted into the keyway 36 of the plug. As an incident thereto, the tumbler pins 50 to 53 are pushed outwardly by the key so as to cause their interfaces with the driver pins 40 to 43 to lie on the shear line 60 as shown in FIG. 4. In addition, the bit at the tip portion of the center user key 61 pushes the tumbler pin 54, the master pin 57 and the driver pin 44 outwardly until the interface between the master pin 57 and the driver pin 44 lies on the shear line. As a result, the plug 35 may be rotated in the cylinder 32 to operate the lock 30.

When inserted into the keyway 36, the master key 62 also may be used to turn the plug 35 and operate the lock 30 (see FIG. 2). When the master key 62 is inserted into the keyway 36, its tip end portion bit pushes the tumbler pin 54, the master pin 57 and the driver pin 44 outwardly until the interface between the tumbler pin 54 and the master pin 57 lies on the shear line 60 (see FIG. 5). Turning of the master key thus is effective to turn the plug.

The left user key 68 and the right user key 69 are identical to the center user key 61 except for the difference in heights between the bits at the tip end portions of the keys. Because of such differences in heights, neither the left user key 68 nor the right user key 69 is effective to permit turning of the plug 35 when the lock is set up in the condition shown in FIGS. 1 to 15 and FIG. 22. The tip end bit of the left user key 68 does not shift the pins 44, 54 and 57 out sufficiently far to bring the interface of the pins 44 and 57 to the shear line 60. The tip end bit of the right user key 69 causes the interface between the pins 44 and 57 to shift outwardly beyond the shear line but cannot shift the pins sufficiently far to cause the interface between the pins 54 and 57 to reach the shear line.

To change the lock 30 over to prevent operation of the lock by the center user key 61 and to permit operation by a selected one of the left or right user keys 68 or 69, the change key 65 is inserted into the keyway 36.

The bitting of the change key 65 is identical to that of the master key 62. Like the master key 62, the change key 65 is effective to bring the interfaces between the pins 40 to 43 and the pins 50 to 53 to the shear line 60 and to bring the interface between the pin 54 and the pin 57 to the shear line 60 (see FIG. 6). Thus, like the master key, the change key may be used to turn the plug 35. Unlike the master key 62, however, the longer tip end portion of the change key 65 extends through the window 102 in the clutch bar 100. As the tip of the change key is inserted through the window 102 its inclined tip surface cams against the upper edge of the window and cams the clutch bar 100 upwardly from an inactive position shown in FIG. 8 to an active position shown in FIG. 10. The relief 110 in the lower edge of the change key 65 receives and accommodates the lower edge portion of the window 102 so as to permit upward shifting of the clutch bar 100.

Figure 13:
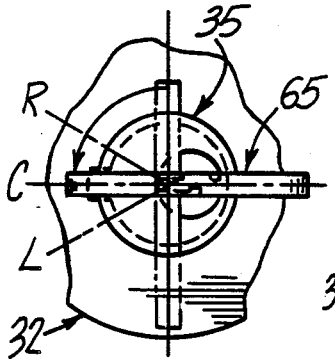
FIG. 13 is a fragmentary elevational view of the forward end of the lock and shows the change key positioned so as to enable subsequent operation of the lock by a first one of the user keys.
Figure 14:
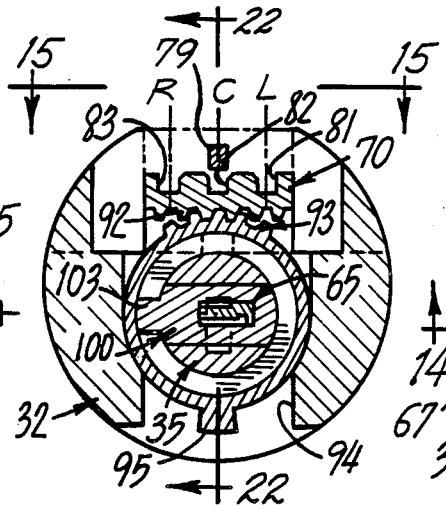
FIG. 14 is a view generally similar to FIG. 8 but looking in the opposite direction, as taken substantially along the line 14—14 of FIG. 15 and shows the change key positioned so as to enable subsequent operation of the lock by the first user key.
Figure 15:
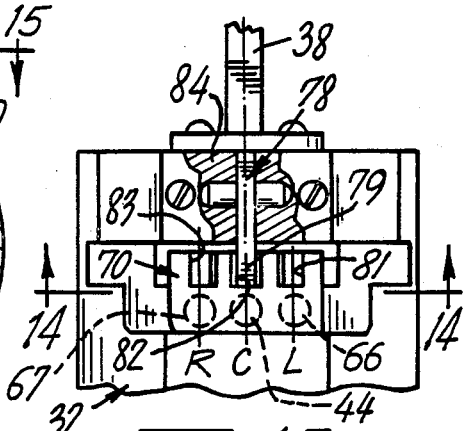
FIG. 15 is a fragmentary top plan view taken substantially along the line 15—15 of FIG. 14 and shows parts positioned to enable subsequent operation of the lock by the first user keys.
Figure 16:
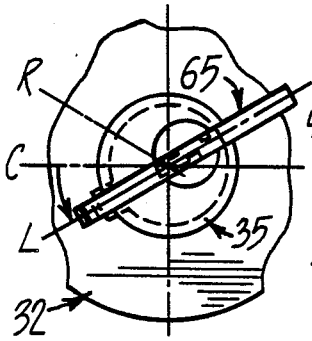
FIGS. 16, 17 and 18 are views similar to FIGS. 13, 14 and 15, respectively, but show the parts of the lock positioned to enable subsequent operation of the lock by a second one of the user keys.
Figure 19:
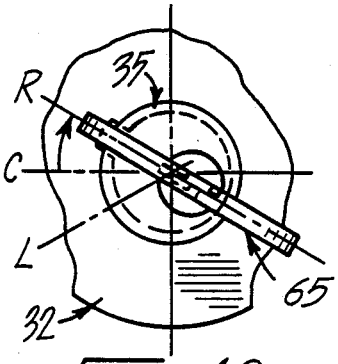
FIGS. 19, 20 and 21 also are views similar to FIGS. 13, 14 and 15, respectively, but show parts of the lock positioned to enable subsequent operation of the lock by a third one of the user keys.
Figure 20:
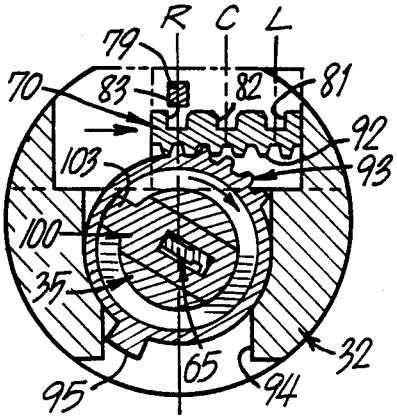
Figure 21:
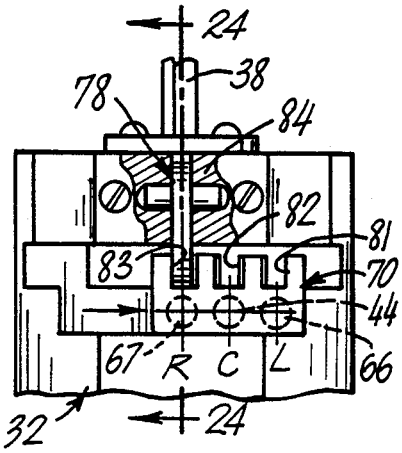

After the change key 65 has been inserted into the keyway 36, the key is rotated counterclockwise or to the left until the plug 35 has turned ninety degrees to a location where the key is disposed in a central horizontal plane labeled "C" in FIG. 1 and in FIGS. 13, 16 and 19. When the plug reaches that location, the lug 103 on the clutch bar 100 becomes alined angularly with the notch 104 in the wall 97 of the gear 93 (see FIGS. 12 and 14). By then using the key 65 to pull the plug 35 forwardly, the lug 103 on the clutch bar 100 is pulled into the notch 104. At the same time, the plug causes the collar 90 to shift forwardly and, as a result, the groove 89 cams against the finger 88 of the detent 78 to pivot the detent upwardly and swing the finger 79 upwardly out of the center pocket 82 of the shuttle 70 (see FIG. 22). This frees the shuttle for transverse movement.

Figure 17:
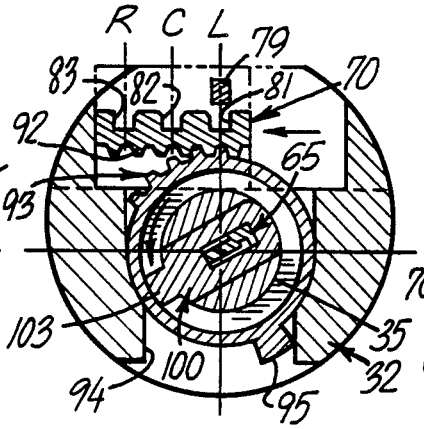
Figure 18:
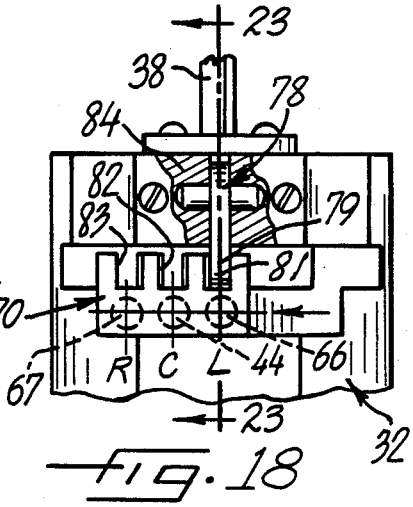

Assuming that it is desired to convert the lock 30 from operation by the center user key 61 to operation by the left user key 68, the change key 65 is rotated further to the left or in a counterclockwise direction to the position labeled "L" in FIG. 1 and FIGS. 13 to 16. As the change key is rotated from the position "C" in FIG. 13 to the position "L" in FIG. 16, the plug 35 turns through an additional thirty degrees and, by way of the clutch bar 100, turns the gear 93. The gear acts against the rack 92 of the shuttle 70 and shifts the shuttle from the centered position shown in FIGS. 14 and 15 to the transversely offset position shown in FIGS. 17 and 18. As an incident thereto, the shuttle shifts the pins 44 and 57 in the chamber 47 from the active position shown in FIGS. 9 and 22 and brings the pins 66 and 73 in the chamber 71 into the active position (see FIG. 18).

The change key 65 then is pushed rearwardly to push the plug 35 rearwardly in the cylinder 35 and shift the lug 103 of the clutch bar 100 out of the notch 104. In addition, rearward movement of the plug causes the collar 90 to pivot the detent 78 counterclockwise and place the finger 79 in the pocket 81 in the shuttle 70. Thereafter, the plug is rotated counterclockwise by the change key 65 through 120 degrees or until the key is vertical. During such rotation, the gear 93 and the shuttle 70 remain stationary as a result of the clutch bar being disengaged from the notch 104 and as a result of the finger 79 being in the pocket 81. After the change key reaches its vertical position, it is removed from the keyway 36. As an incident thereto, a lobe 115 (FIGS. 6, 11 and 25) on the extreme free end of the change key cams against the lower edge of the window 102 and forces the clutch bar downwardly toward its original position shown in FIGS. 8 and 10.

With the pins 63 and 73 being located in the active position in alinement with the rear tumbler pin 54, the lock 30 may be operated by the left user key 68 but not by the center user key 61 or the right user key 69. The lock also may be operated by the master key 62. The interface between the pins 54 and 73 is shifted to the shear line 60 when the master key is inserted into the keyway 36.

It should be noted at this point that none of the keys 61, 62, 68 or 69 is capable of effecting transverse shifting of the shuttle 70. When any one of such keys is inserted into the keyway 36, its tip end portion extends into the window 102 of the clutch bar 100 and engages the bottom edge portion of the window to cam the clutch bar and to hold the clutch bar radially inwardly in its inactive position shown in FIGS. 8 and 11. When the clutch bar is in its inactive position, its end 116 opposite the lug 103 engages the wall 97 of the gear 93. Such engagement prevents the plug 34 from being pulled forwardly. Also, the lug 103 of the clutch bar 100 is prevented from entering the notch 104 and, as a result, the gear 93 and the shuttle 70 remain stationary when the plug 35 is turned by any one of the keys 61, 62, 68 or 69.

Figure 24:
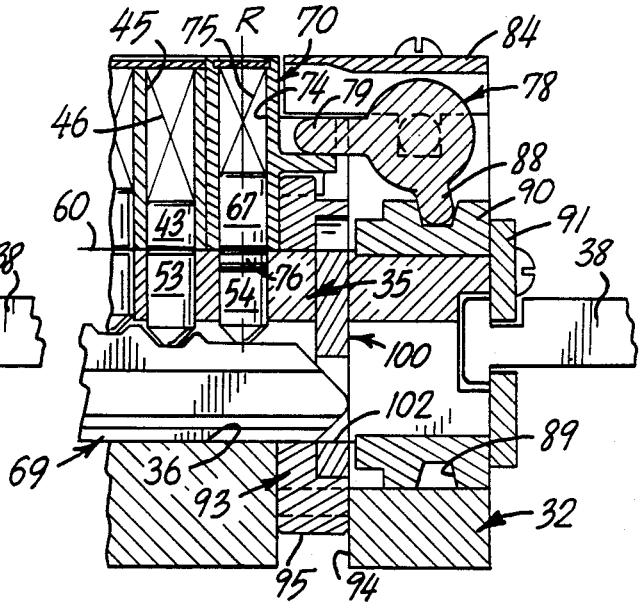
FIG. 24 is an enlarged fragmentary cross-section taken substantially along the line 24—24 of FIG. 21 and shows the in conjunction with the third user key.

Assume now that there is a need to convert the lock 30 from operation by the left user key 68 to operation to the right user key 69. To effect such conversion, the change key 65 again is inserted into the keyway 36 and is rotated counterclockwise or to the left through 120 degrees to the position designated as "L" (see FIG. 16). Upon reaching that position, the key is given a gentle pull in order to pull the plug 35 forwardly and cause the lug 103 of the clutch bar 100 to enter the notch 104. Forward shifting of the plug also causes the collar 90 to pivot the detent 78 clockwise and release the finger 79 from the pocket 81 of the shuttle 70. The change key 65 then is turned clockwise or to the right through sixty degrees to the position designated "R" in FIG. 19. During such turning, the clutch bar 100 turns the gear 93 clockwise through sixty degrees to shift the chamber 71 transversely out of the active position, to shift the chamber 47 transversely past the active position, and to shift the chamber 74 with the pins 67 and 76 therein into the active position. The change key 65 then is pushed rearwardly to return the plug 35 rearwardly to its normal position, to shift the lug 103 of the clutch bar 100 out of the notch 104 and to cause the collar 90 to pivot the detent 78 to a position in which the finger 79 enters the pocket 83 in the shuttle 70. The plug 35 then is rotated through an additional sixty degrees and the change key 65 is removed. With the pins 67 and 76 in the active position (see FIG. 24), the lock 30 can be operated by the right user key 69 but not by the center or left user keys 61 or 68. The lock also can be operated by the master key 62 since the interface between the pins 54 and 73 is shifted to the shear line 60 when the master key is inserted into the keyway 36.

To reset the lock 30 for operation by the center user key 61, the change key 65 is once again inserted into the keyway 36 and is rotated counterclockwise or to the left through sixty degrees to the position designated "R" in FIGS. 13, 16 and 19. At this position, the plug 35 is pulled forwardly with the key 65 to engage the clutch bar 100 and to disengage the detent 78. The key then is turned counterclockwise through an additional thirty degrees to the position designated "C". As an incident to such turning, the shuttle 70 is moved transversely to shift the chamber 74 out of the active position and return the chamber 47 and the pins 44 and 57 therein to the active position. After the plug 35 has been pushed rearwardly, the change key is rotated clockwise through ninety degrees and is removed. With the pins 44 and 57 once again in the active position, the center user key 61 may again be used to operate the lock 30.

From the foregoing, it will be apparent that the present invention brings to the art a new and improved re-keyable lock 30 in which the change key 65 may be used to convert the lock for exclusive use by any one of the three user keys 61, 68 or 69. The conversions may be made without adding any parts to or removing any parts from the lock and may be made an indefinite number of times throughout the service life of the lock.

I claim:

1. A lock operated by a first user key and changed over by a change key to prevent operation of said lock by said first user key and to enable operation of said lock by a second user key having bitting different from the bitting of the first user key, said lock comprising a cylinder, a series of driver chambers located in and spaced axially along said cylinder, drive pins located in said chambers and movable radially therein, an elongated plug supported to rotate in said cylinder and to receive any one of said keys, a series of tumbler chambers located in and spaced axially along said plug and alined angularly and axially with said driver chambers, tumbler pins located in said tumbler chambers and movable radially therein, the interface between each tumbler pin and each aligned pin in said cylinder being spaced radially from a shear line between said plug and said cylinder and preventing rotation of said plug in said cylinder, the interface between at least a part of said tumbler pins and at least a part of said alined pins in said cylinder being located radially on said shear line when said first user key or said change key is inserted into said plug whereby said plug may be rotated within said cylinder by either of such keys, an additional driver chamber spaced transversely from one of said driver chambers, an additional drive pin located in said additional driver chamber and having a length different from the length of the drive pin in said one driver chamber, responsive means being responsive to rotation of said plug by said change key to shift said one driver chamber and the drive pin therein transversely out of alinement with the associated one of said tumbler chambers and to shift said additional driver chamber and the drive pin therein transversely into alinement with such tumbler chamber thereby to prevent operation of said lock by said first user key and to convert said lock for operation by said second user key, and a shuttle movable transversely of said cylinder and containing said one driver chamber and said additional driver chamber, said responsive means comprising a rotary member and further comprising a member for converting turning of said rotary member into transverse movement of said shuttle, and means for selectively coupling said rotary member for rotation with said plug.

2. A lock as defined in claim 1 further including a second additional driver chamber spaced transversely from said one driver chamber and from said first additional driver chamber, a second additional drive pin located in said second additional driver chamber and having a length different from the length of the drive pin in said one driver chamber and different from the length of said first additional drive pin, said second additional chamber and the second additional drive pin therein being shiftable transversely into alinement with said one tumbler chamber in response to rotation of said plug by said change key thereby to prevent operation of said lock by said first and second user keys and to convert said lock for operation by a third user key of still different bitting.

3. A lock as defined in claim 1 in which said coupling means comprise a clutch member movable between an active position coupling said rotary member for rotation with said plug and an inactive position uncoupling said rotary member from said plug, and means on the tip end portion of said change key for shifting said clutch member toward said active position when said change key is inserted into said plug.

4. A lock as defined in claim 3 in which said plug is supported to slide axially in said cylinder when said change key is in said plug and when said plug is in a predetermined angular position, and detent means for releasably holding said shuttle against transverse movement, said detent means in its active position releasing said shuttle when said plug is slid axially in a predetermined direction in said cylinder.

5. A lock as defined in claim 4 in which said detent member is moved into said active position thereof when said plug is pulled axially in said predetermined position in said cylinder.

6. A lock as defined in claim 1 further including master pins in said one driver chamber and in said additional driver chamber, said master pins being of different lengths.

7. A lock operated by a first user key and changed over by a change key to prevent operation of the lock by the first user key to enable operation of the lock either by a second user key of different bitting or by a third user key of still different bitting, said lock comprising a cylinder having front and rear ends, a series of driver chambers formed in and spaced axially along said cylinder, a shuttle member located adjacent the rear end of said cylinder and having first, second and third additional driver chambers spaced transversely from one another, said first additional driver chamber in said shuttle member being located between said second and third additional driver chambers and being alined angularly with the driver chambers in said cylinder, drive pins located in all of said driver chambers and movable radially therein, the drive pins in said additional chambers all being of different lengths, an elongated plug supported to rotate in said cylinder and adapted to receive any one of said keys, said plug having an inner end, a series of tumbler chambers formed in and spaced along said plug and alined angularly and axially with said series of driver chambers in said cylinder, an additional tumbler chamber formed in said plug adjacent the inner end thereof and alined angularly and axially with said first additional driver chamber in said shuttle, tumbler pins located in all of said tumbler chambers and movable radially therein, the interface between each tumbler pin and each alined pin in said cylinder being spaced radially from a shear line between said plug and said cylinder and preventing rotation of said plug in said cylinder, the interface between at least a part of said tumbler pins and at least a part of said alined pins in said cylinder being located radially at said shear line when said first user key or said change key is inserted into said plug whereby said plug may be rotated within said cylinder either by said first user key or by said change key, and means responsive to clockwise rotation of said plug from a predetermined angular position by said change key to move said shuttle member transversely of said cylinder and said plug in one direction so as to shift said first additional driver chamber and the pin therein out of alinement with said additional tumbler chamber and to shift said second additional driver chamber and the drive pin therein into alinement with said additional tumbler chamber, said means being responsive to counterclockwise rotation of said plug by said change key from said predetermined angular position to move said shuttle member transversely of said cylinder and said plug in the opposite direction so as to shift said first additional driver chamber and the drive pin therein out of alinement with said additional tumbler chamber and to shift said third driver chamber and the drive pin therein into alinement with said additional tumbler chamber.

8. A lock as defined in claim 7 in which said shuttle member includes a toothed rack and in which said means comprise a rotatable gear meshing with said rack, said plug being supported for axial sliding in said cylinder, and means responsive to insertion of said change key into said plug and to forward sliding of said plug to couple said gear for rotation with said plug whereby said gear shifts said rack to move said shuttle member.

9. A lock as defined in claim 8 further including a detent normally engaging said shuttle to prevent movement thereof, said plug being operable when slid forwardly to release said detent from said shuttle.

* * * * *